US005906519A

United States Patent [19]

Nix et al.

[11] Patent Number: 5,906,519

[45] Date of Patent: May 25, 1999

[54] ELECTRICAL CONNECTOR

[75] Inventors: Lothar Heinrich Willi Nix, Mörfelden-Walldorf; Franz-Josef Thiel, Weiterstadt; Konstantin Gossen, Pfungstadt, all of Germany

[73] Assignee: The Whitaker Corporation, Wilmington, Del.

[21] Appl. No.: 08/911,055

[22] Filed: Aug. 14, 1997

Related U.S. Application Data

[63] Continuation of application No. 08/587,116, Jan. 11, 1996, abandoned.

[30] Foreign Application Priority Data

Jan. 17, 1995 [GB] United Kingdom ..... 9500877

[51] Int. Cl.[6] ..... H01R 13/434

[52] U.S. Cl. ..... 439/752

[58] Field of Search ..... 439/752

[56] References Cited

U.S. PATENT DOCUMENTS

| | | | |
|---|---|---|---|
| 4,867,711 | 9/1989 | Yuasa | 439/752 |
| 4,867,712 | 9/1989 | Kato et al. | 439/752 |
| 5,017,162 | 5/1991 | Krehbiel et al. | 439/752 |
| 5,593,326 | 1/1997 | Listing | 439/752 |

FOREIGN PATENT DOCUMENTS

| | | |
|---|---|---|
| 0 007 709 | 2/1980 | European Pat. Off. . |
| 317755 | 10/1988 | European Pat. Off. . |
| 373498 | 12/1989 | European Pat. Off. . |
| 522427 | 7/1992 | European Pat. Off. . |
| 4123505 | 7/1991 | Germany . |
| 4207 091 | 3/1992 | Germany . |

*Primary Examiner*—Gary Paumen
*Assistant Examiner*—Briggitte R. Hammond
*Attorney, Agent, or Firm*—Driscoll A. Nina

[57] ABSTRACT

An electrical connector comprising a housing having a terminal receiving passageway extending therethrough, where the passageway includes an insertion portion having a longitudinal axis and a contact retaining portion having a longitudinal axis, the connector characterized in that the housing includes a first part having the insertion portion therein and a second part having the contact retaining portion therein, where the second part is displaceable between a first position where the longitudinal axes are offset from each other to a second position where the longitudinal axis coincide and where the terminals are insertable in the first position and retained in the second position. A position assurance feature for contact retaining members is also provided by cooperating camming features that assure assembly of the two parts is always in the first position.

10 Claims, 7 Drawing Sheets

ELECTRICAL CONNECTOR

This application is a continuation of U.S. application Ser. No. 08/587,116 filed Jan. 11, 1996, now abandoned.

BACKGROUND OF THE INVENTION

1. Field of the Invention

This invention relates to an electrical connector and in particular to an electrical connector housing wherein terminals are disposed having a positive retention structure to assure the contacts are retained therein.

2. Description of the Prior Art

Modern electrical connector housings, and particularly those used in automotive applications, include a number of desirable features. These electrical connectors can prevent the ingress of contaminates by incorporating sealing members so that the electrical interconnection does not deteriorate. It is also known to incorporate shoulders into a terminal receiving cavity such that locking lances extending outward from the terminal interfere with these shoulders to assure that the terminal is properly positioned and retained within the cavity. Furthermore, in order to assure that the terminals remain in their proper position, secondary locking members which are displaceable between an open position wherein the terminal may be seated in the passageway and a locked position where the secondary locking member now obstructs the passageway such that it would interfere with the inserted terminal to prevent removal from the passageway. Finally, it is also known to incorporate position assurance features for the secondary locking member that would prevent a mating connector half from being connected thereto unless the secondary locking member is properly positioned to retain the contacts. Furthermore, it is also known to incorporate coding features into the connector to assure that mating connectors are complementary to each other and properly oriented at the time of mating.

While all of these features are known, incorporating them into a single electrical connector has resulted in complicated structure that may not be easily manipulated by an installer. Furthermore, this complicated structure typically will involve multiple components which are difficult to keep in place during assembly and prior to assembly, such as during storage or shipping.

SUMMARY OF THE INVENTION

It is an object of this invention to provide a simple and robust electrical connector housing wherein electrical terminals may be positively retained therein.

It is another object of this invention to provide a simple electrical connector housing having a minimal number of parts wherein the terminals may be easily inserted, positively retained therein and provided with anti-back-out protection.

It is yet another object of this invention to provide an electrical connector housing incorporating the aforegoing objects and further preventing mating with a complementary connector unless the anti-back-out protection is properly activated.

It is still another object of this invention to make the electrical connector according to anyone of the aforegoing objects contaminant-tight.

These and other objects are accomplished by providing an electrical connector comprising a housing having a terminal receiving passageway extending therethrough, where the passageway includes an insertion portion having a longitudinal axis and a contact retaining portion having a longitudinal axis, the connector characterized in that the housing includes a first part having the insertion portion therein and a second part having the contact retaining portion therein, where the second part is displaceable between a first position where the longitudinal axes are offset from each other to a second position where the longitudinal axis of the insertion portion and the contact retaining portion coincide and where the terminals are insertable in the first position and retained in the second position.

It is an advantage of this invention that a minimum number of components are required. It is another advantage of this invention that in the offset first position, the terminals may be inserted into the passageway while a complementary connector is prevented from mating therewith. It is still another advantage of this invention that in the second position a locking shoulder formed on the first part blocks the terminal from being withdrawn from the passageway. It is still yet another advantage of this invention that seals may be disposed upon the connector and retained thereupon by the second part.

While a connector of the type described above has a number of advantages there is a problem presented in that during assembly of the contact retaining portion to the housing it is desired that the contact retaining portion be received thereupon in the first position so that the terminals may be easily received in their respective passageways. It is important to note that as the contact retaining portion is typically latched to the housing, it is not done so in a way that makes movement between the first and second positions equally easy independent of which way the housing/contact retaining portions are moved. For example, as it is undesirable for the secondary locking or positive contact retention features to be easily released the latching structure is typically constructed in a way that makes movement between the first to the second position relatively easy to accomplish, but movement between the second to the first position difficult or impossible without damage to the connector or use of special tools. This means that, as the contact retaining portion is being attached to the housing, it would be desirable to assure it will only be affixed thereto in the first position. This would then eliminate any loss of time or materials due to improper assembly.

This problem is solved by providing the housing and the contact retaining portion with complementary camming features that cooperate as the contact retaining portion is being fitted to the housing to assure that prior to being latched thereto the contact retaining portion is biased by way of camming feature cooperation into the first position. In one particularly advantageous embodiment of the present invention an electrical connector comprises a housing and a contact retaining portion where the housing includes passageways extending therethrough for receiving terminals and the contact retaining portion is configured to positively retain the terminals within the passageway as a result of displacement from a first position where the terminals are receivable and a second position where the terminals are blocked from being withdrawn; the connector being characterized in that the contact retaining portion and the housing include complementary camming features that cooperate to assure the contact retaining portion can only be received on the housing in the first position.

DETAILED DESCRIPTION OF THE PREFERRED EMBODIMENT

Figure 1:
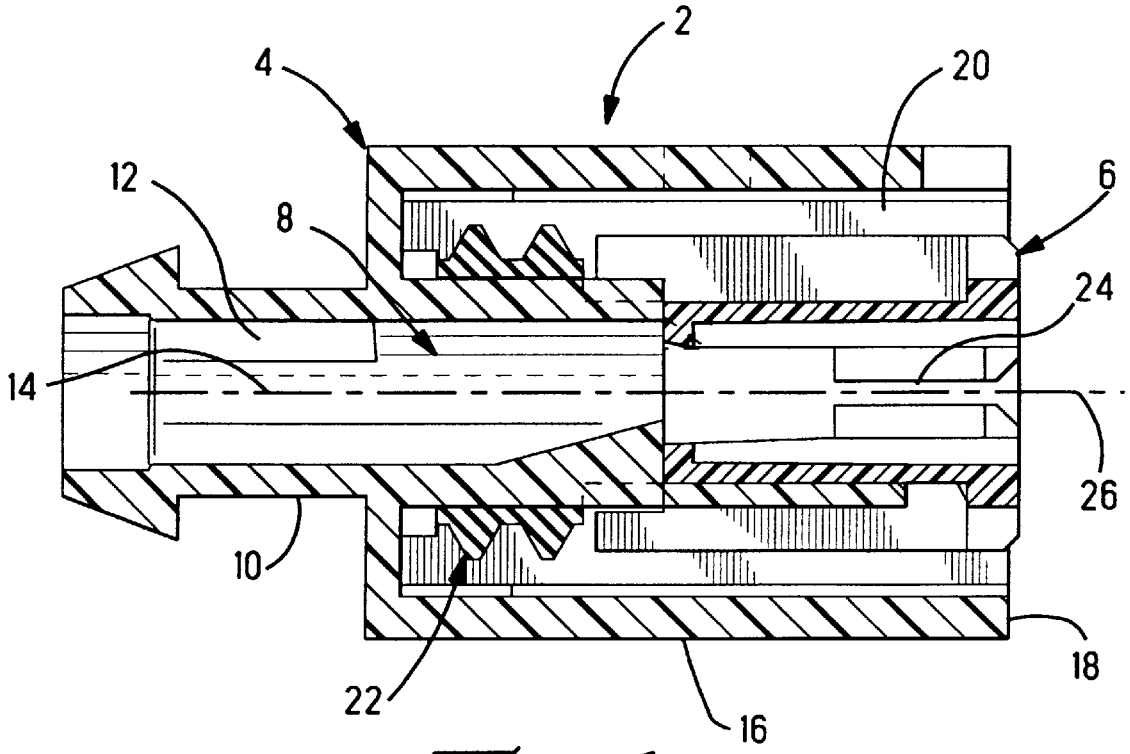
FIG. 1 is a cross-sectional view of an electrical connector housing according to the present invention.

With reference now to FIG. 1, an electrical connector housing according to the present invention is shown generally at 2. The electrical connector 2 includes a first part 4 and a second part 6 where a terminal receiving passageway 8 extends therethrough. The first part 4 includes a body portion 10 wherein an insertion portion 12 of the terminal receiving passageway 8 extends longitudinally therethrough. The insertion portion 12 defines a first longitudinal axis 14. Integrally formed with the body portion 10 is an outer shroud 16 that extends forwardly to a mating end 18. The shroud 16 is disposed outward from the body 10 to define an annular receiving cavity 20 that is open at the front mating end 18 for closely receiving a shroud of a mating component (not shown). Disposed within this annular cavity 20 about a portion of the body 10 is a seal member 22 which interacts with the internal surfaces of the shroud of the mating component to form a contaminant-tight seal. The second part 6 is also encompassed by the shroud 16 and includes a contact retaining portion 24 of the terminal receiving passageway 8. The contact retaining portion 24 defines a second longitudinal axis 26 that extends therethrough.

Figure 3:
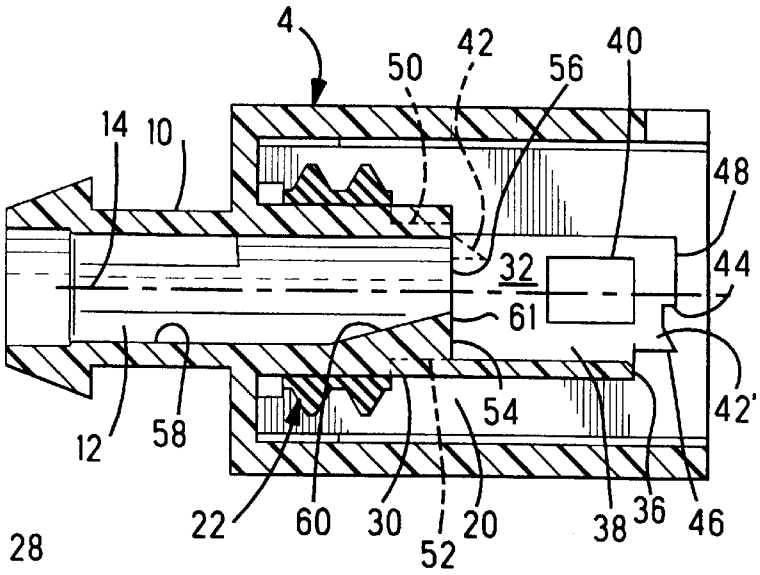
FIG. 3 is a cross-sectional view of the first part of the connector housing of FIG. 2 taken along line 3—3.
Figure 2:
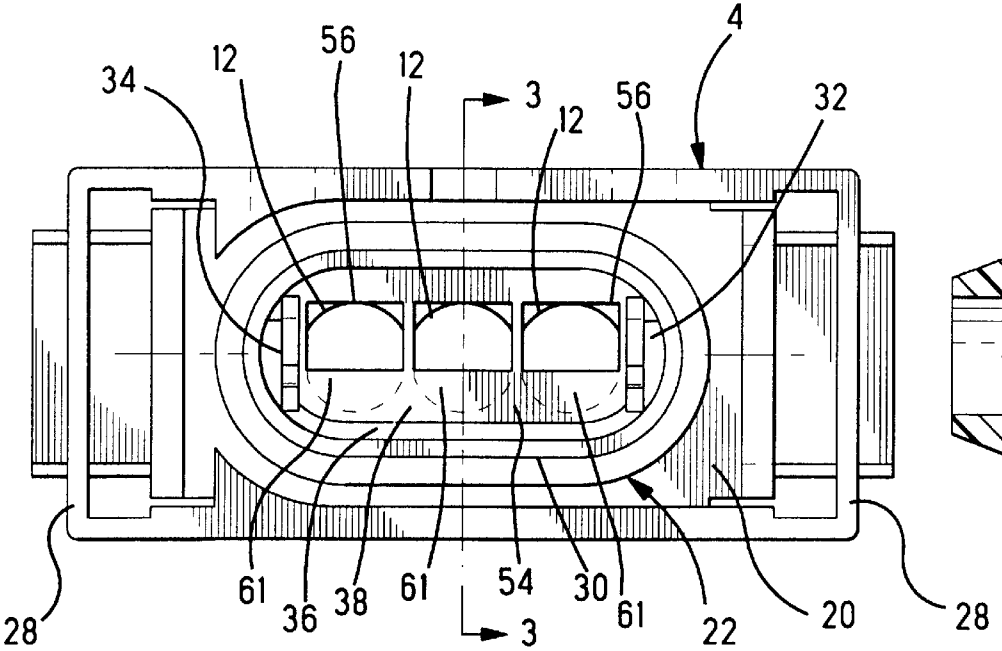
FIG. 2 is a front view of the first part of the electrical connector housing of FIG. 1.
Figure 6:
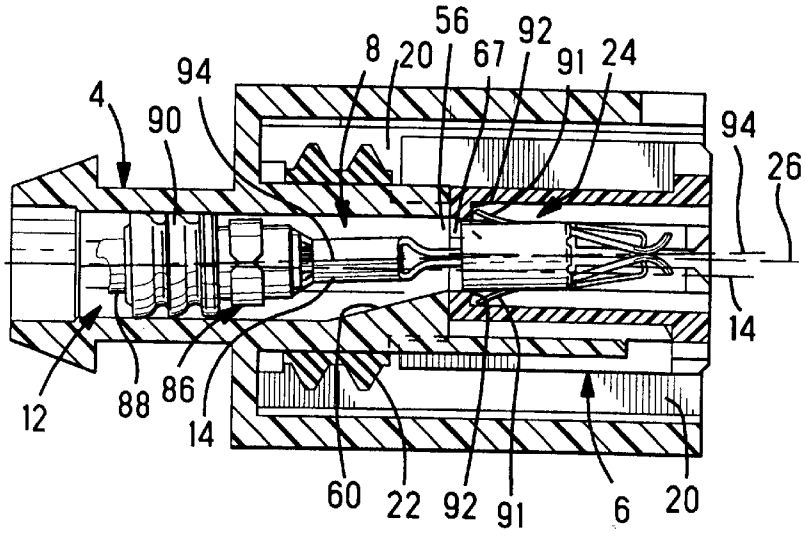
FIG. 6 is a cross-sectional view of the electrical connector housing of FIG. 5 taken along line 6—6 and showing a terminal inserted therein.
Figure 8:
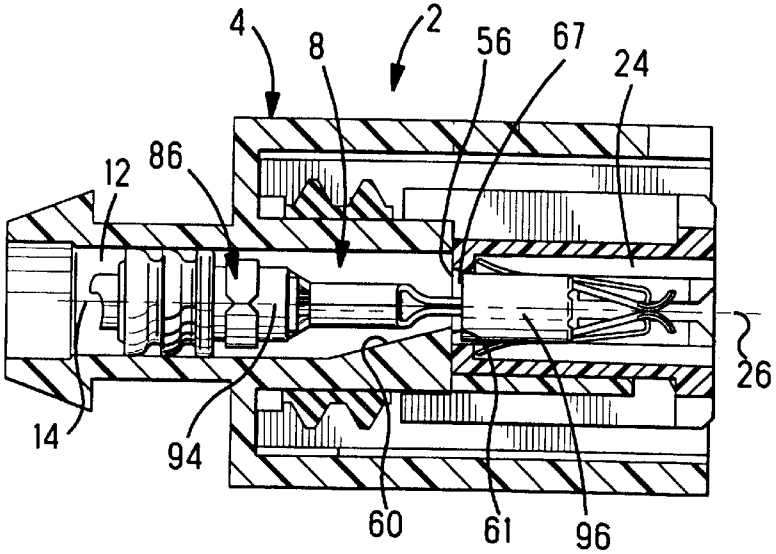
FIG. 8 is a cross-sectional view of the electrical connector housing of FIG. 7 taken along line 8—8.

With reference now to FIG. 2 and FIG. 3, the first part 4 will be described in greater detail. The first part 4 is shown in this embodiment as being generally rectangular in shape having latching members 28 at either end thereof for cooperating with the mating connector component (not shown) to effect positive retention of the contacts (FIG. 6 and FIG. 8). The first part 4 includes a single row of three insertion portions 12 of the terminal receiving passageway 8. It should be appreciated that, while only a single row is shown, additional configurations having a greater or lesser number of rows with more-or-less insertion portions 12 incorporated therein would be obvious in light of the present invention. In addition, while the present invention is illustrated with a generally rectangular connector, it would be applicable to other configurations as well, such as circular. The seal 22 is carried upon an inner sealing surface 30 and exposed to the annular cavity 20. Spanning the array of insertion portions 12 are a pair of sides 32,34 that are integrally connected with a base member 36 to form a wide U-shaped seating channel 38 therebetween.

With reference now to FIG. 3, side 32 is similarly configured to side 34, both of which include a port 40 therethrough for receiving a boss (not shown) on the second connector part 6 for longitudinally retaining the second connector part 6 with the first connector part 4. Along the side 32, and outward of the seat 38, is formed a triangular latching barb 42' that works in conjunction with first and second latching shoulders 44,46 respectively, at the mating free end 48 of the side 32, to assure that the second part 6 is stabily maintained in both the first and second positions, as will be described below. Forward of the seal 22, along the sealing surface 30 of the body 10, are partial notches 50,52 which serve to receive a portion of the second part 6 to assure the seal 22 remains properly positioned. The walls 32,34 and the base 36 extend outward from a mating face 54. The insertion portion 12 is open at the mating face through a rectangular opening 56, the rectangular opening 56 transitions thereto from a cylindrical seal seat 58 at least partially through a ramp 60 so that the opening 56 is offset from the longitudinal axis 14 thereby providing a stop shoulder 61 along face 54 for retaining a contact therein.

Figure 4:
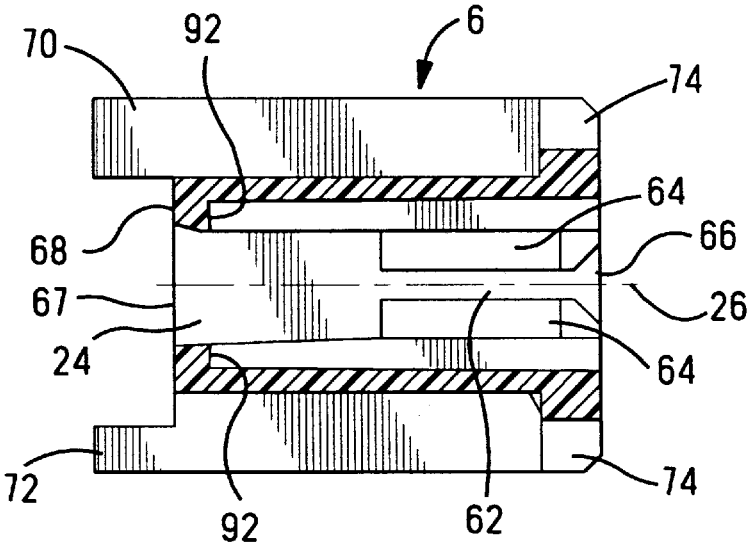
FIG. 4 is a sectional view of the second part of the electrical connector housing of FIG. 1 taken along a line coinciding to the sectional view of FIG. 3.

With reference now to FIG. 4, the second part 6 will be described in greater detail. The second part 6 includes the contact retaining portion 24 extending along axis 26. The contact retaining portion 24 includes a guide section 62 wherein multiple ribs 64 form a cross-shaped opening 66 (best seen in FIG. 5 and FIG. 7) for receiving a blade contact of mating connector component (not shown). The second part includes contact retaining portions 24 corresponding in number and arrangement to the insertion portions 12 of the first part 4 of the connector housing 2. Opposite the cross-like openings 66, the contact retaining portions 24 are open at 67 along a rear face 68. Extending rearward from the rear face 68 are a pair of seal-captivating members 70,72 that seat within corresponding notches 50,52 to assure that the seal 22 remains captivated upon body portion 10 of the first part 4. The second part 6 also includes coding openings 74 on opposite sides of the contact retaining portions 24 to assure that the proper mating is achieved. Note, it is advantageous that the only modification needed for differently coded connectors is to the moulds used to produce the second part 6. It may also be possible to manipulate the second part 6 between the first position and a second position by way of these coding openings 74.

Figure 5:
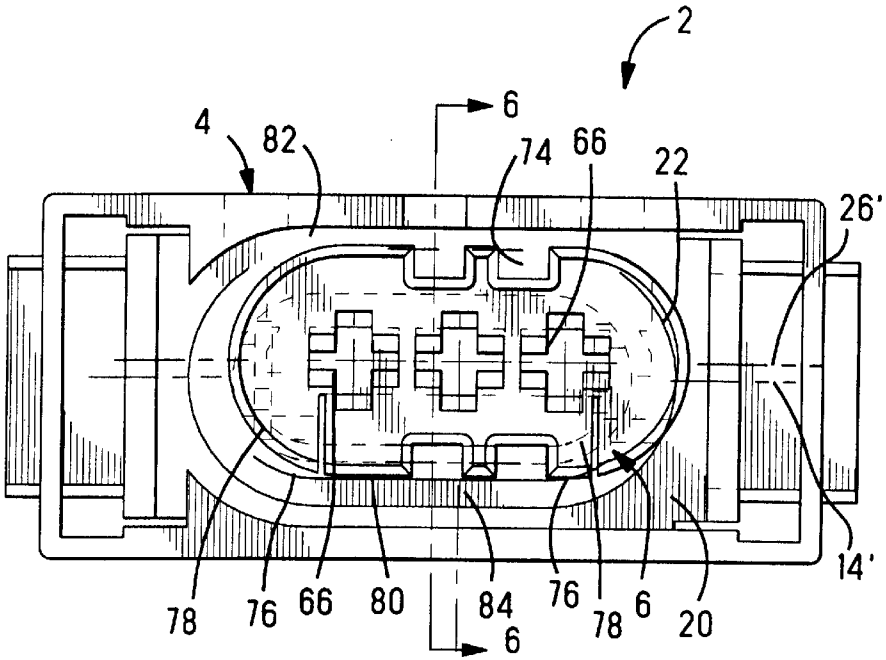
FIG. 5 is a front view of the electrical connector housing of FIG. 1 showing the second part in the first position.

With reference now to FIG. 5, the electrical connector housing 2 is shown with the second part 6 mounted upon the first part 4 in a first preloaded position. The first preloaded position is established and stabily maintained by interaction of catches (not shown) with the latches 42 and the boss (not shown) with the port 40 as previously described with reference to FIG. 3. The second part 6 includes a pair of slits 76 that partially separate outer extremities 78 from the remainder of the second part 6 so that the second part 6 may be displaced into the second position, as described below, by providing resiliency to the portion of the second part 6 which carries the catches (not shown) which interact with the latches 42 as previously described.

The second part 6 further includes an outer peripheral edge 80 extending therearound which can be seen to be offset from the seal member 22 such that the region 82 above the second member 6 is less than the region 84 below the second part 6. This can also be observed by comparing transverse lines 26' and 14' which interconnect the longitudinal axes 14,26 of the portions of the passageway 8 in second part 6 and the first part 4 respectively. In this first position, as better seen in FIG. 6, the longitudinal axes 14,26 of the respective first and second parts 4,6 are offset from each other. However, the opening 56 in the first part corresponds to the opening 67 in the second part such that a continuous passageway is formed therethrough, whereby a contact 86 may be inserted and retained.

The electrical connector contact 86 is terminated to an electrical conductor 88 and a single wire sealing member 90 is disposed thereupon. As this structure is inserted into the insertion end 12, the contact rides up and over ramp 60 and into the contact retaining portion 24 such that locking lances 91 are behind shoulders 92 in the contact retaining portion 24. The contact 86 and its associated conductor 88 define another longitudinal axis 94, which due to the misalignment of the longitudinal axes 14,26 of the first and second parts 4,6 is angularly skewed relative thereto. However, the rectangular opening 56, as described with reference to FIG. 2 and FIG. 3, properly orients and accepts the contact 86 within the second part 6.

As can be observed from FIG. 5 and FIG. 6, with the second part 6 in this first position, it would not be possible to insert the shroud of a mating connector component (not shown) into the annular cavity 20. As it is not possible to insert the annular shroud, the connector housing 2 cannot be mated with corresponding connector component in the first position. However, in the first position it is possible to insert the electrical contacts into the housing 2.

Figure 7:
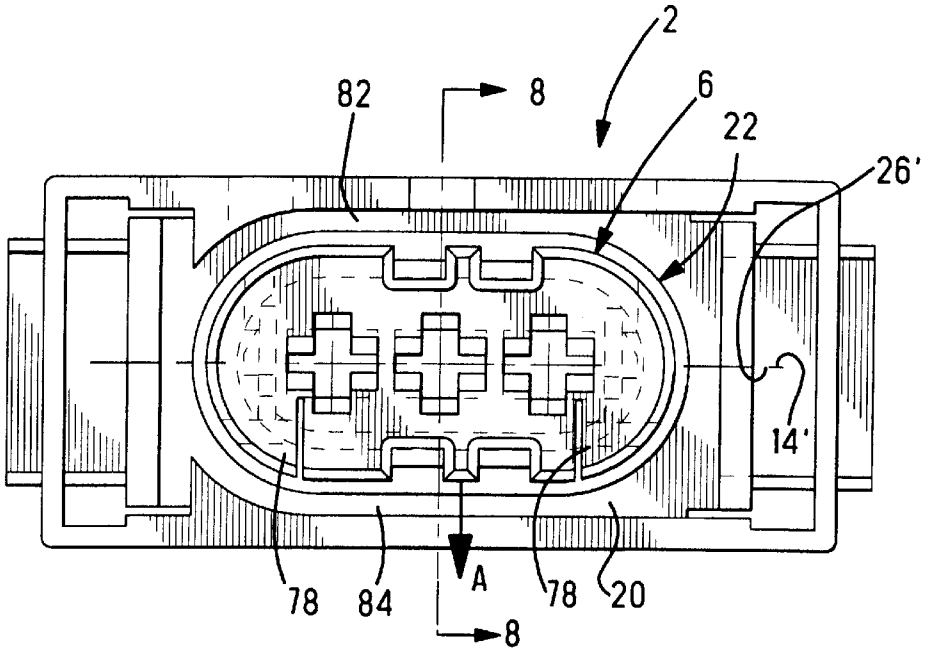
FIG. 7 is a front view of the electrical connector housing of FIG. 1 showing the second part in the second position.

With reference now to FIG. 7, the second part 6 is shifted down in the direction of arrow A so that the upper region 82 and the lower region 84 of the annular cavity 20 are now of corresponding size so that the shroud of a mating connector component (not shown) may be inserted therein. In this second position, the second part 6 is correspondingly aligned with the seal 22 and lines 14',26' that interconnect the axes 14,26 coincide. In moving the second part 6 downward in the direction of arrow A, the extreme portions 78 are able to deflect so that the catches (not shown) pass over ramp surface (FIG. 3) located above latch surface 46 and correspondingly, the catches associated with the latches 42 also are displaced.

With reference now also to FIG. 8, the longitudinal axes 14,26,94 defined by the insertion portion 12, the contact retention portion 24 and the contact 86 coincide. Furthermore, in this second position the opening 56 and the opening 67 are no longer aligned and the effective opening therethrough is reduced to less than the contact body 96 such that the shoulder 60 along face 54 of the first part 4, realized by the ramp 60, acts as a locking shoulder to prevent the contact 86 from being withdrawn from the contact receiving passageway 8.

Figure 9:
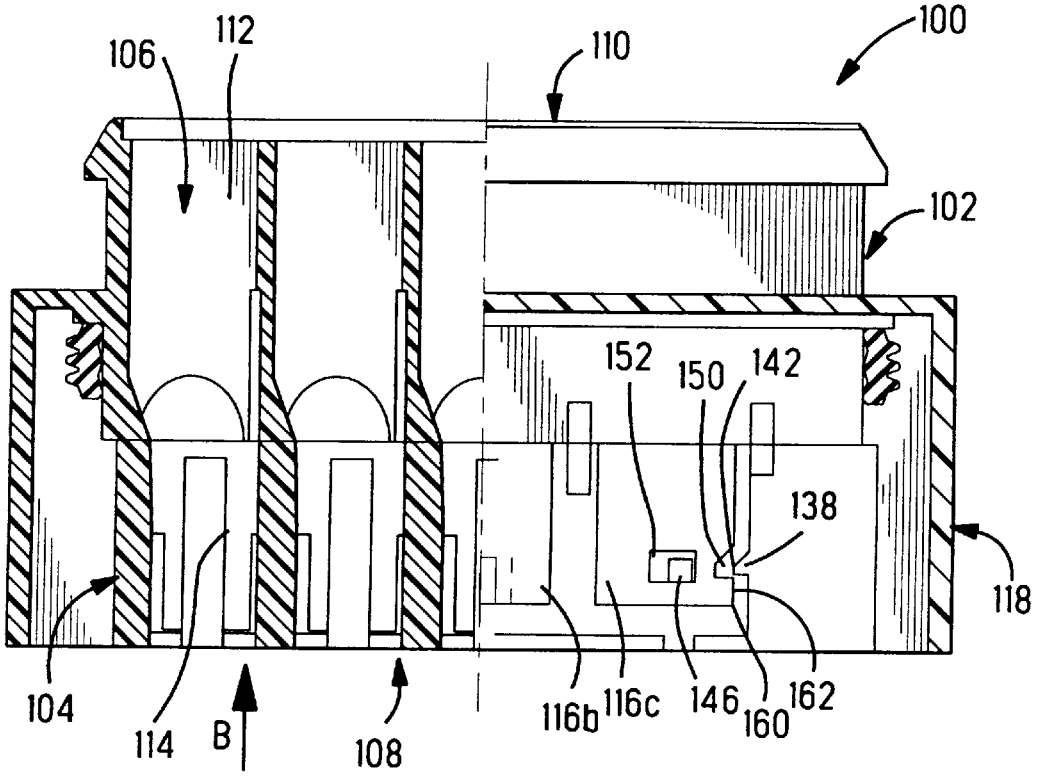
FIG. 9 shows an upper partially cut away view of an electrical connector incorporating another aspect of the present invention.
Figure 10:
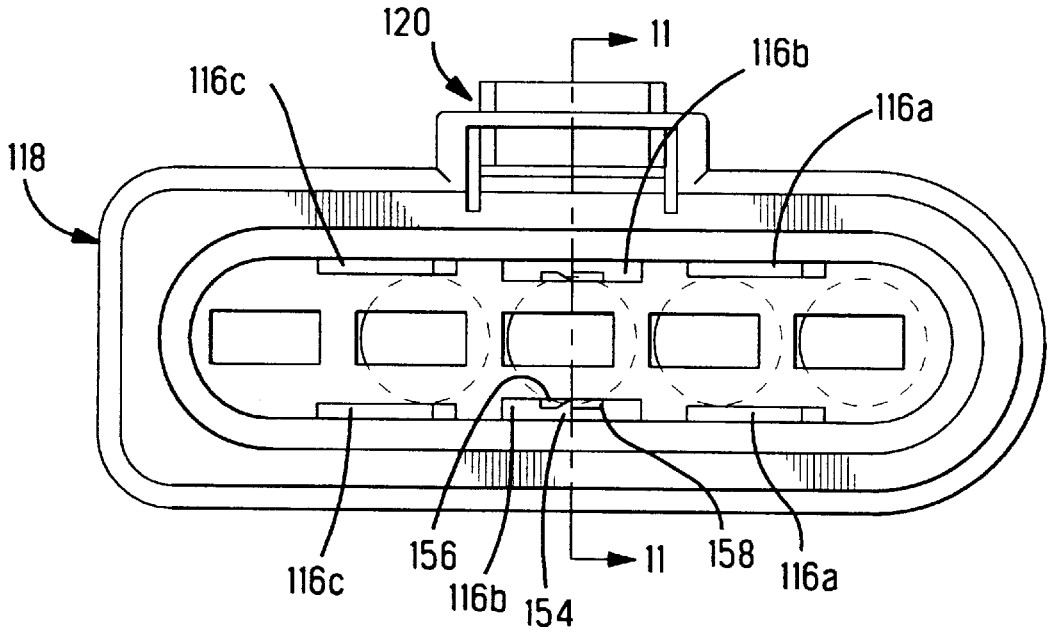
FIG. 10 shows a front view of a connector housing incorporated into the electrical connector of FIG. 9.
Figure 11:
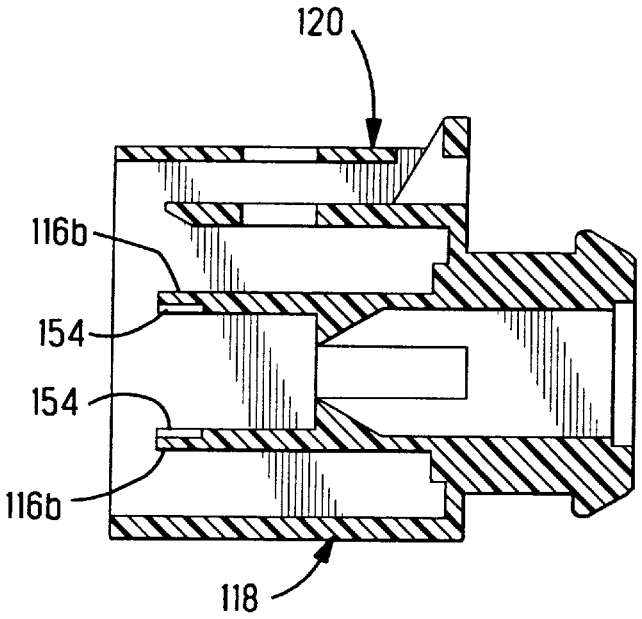
FIG. 11 shows a side sectional view of the connector housing of FIG. 10 taken along line 11—11.
Figure 12:
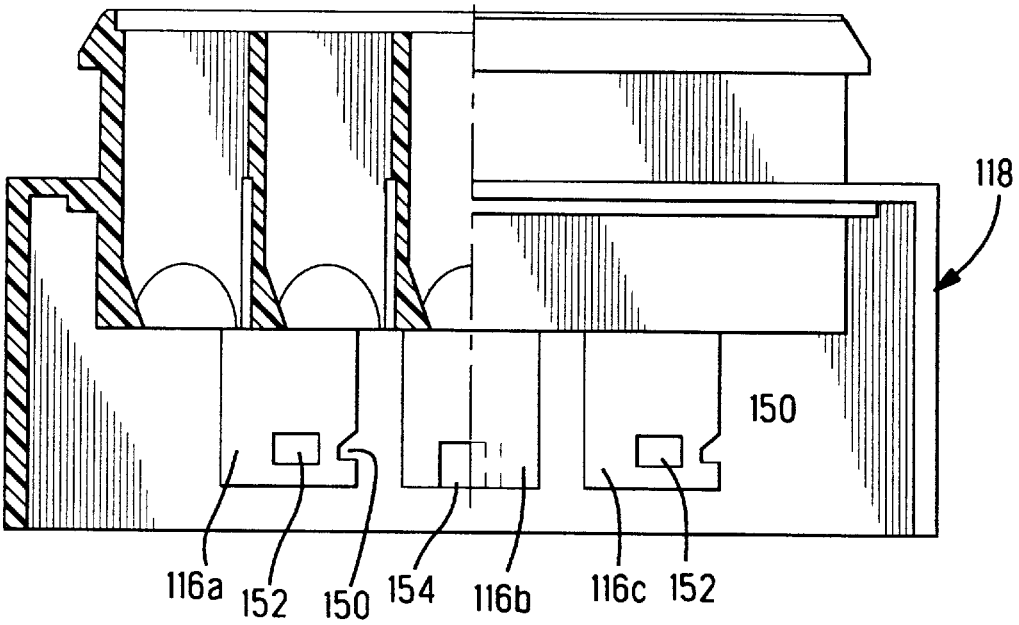
FIG. 12 shows an upper partially cut away view of the connector housing of FIG. 10.

With reference now to FIGS. 9–15, an electrical connector corresponding generally to that described above is shown generally at 100 in FIG. 9. The connector 100 includes a housing 102 and a contact retaining member 104 that positively retains terminals (not shown) within passageways 106 that extend between a mating end 108 and a wire receiving end 110. As previously described, each passageway 106 includes an insertion portion 112 and a contact retaining portion 114 in the housing 102 and the contact retaining member 104, respectively, that function similarly. The housing 102 includes multiple wings **116*a–c* that function to position and retain the contact retaining member 104 as is described below. In the embodiment, the wings 116*a–c* are arranged in corresponding opposed pairs, as best seen in FIGS. 10 and 11. The wings 116*a–c* pairs are disposed within a forwardly extending shroud 118 that surrounds the area wherein the mating connector (not shown) is received. As further shown in FIGS. 10 and 11, a latching structure 120** is provided for holding the mated connectors together.

Figure 15:
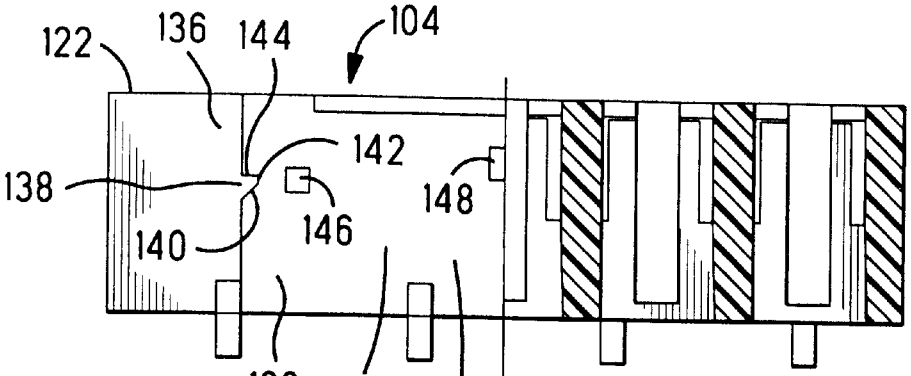
FIG. 15 shows an upper partially cut away view of the contact retention portion of FIG. 13.
Figure 13:
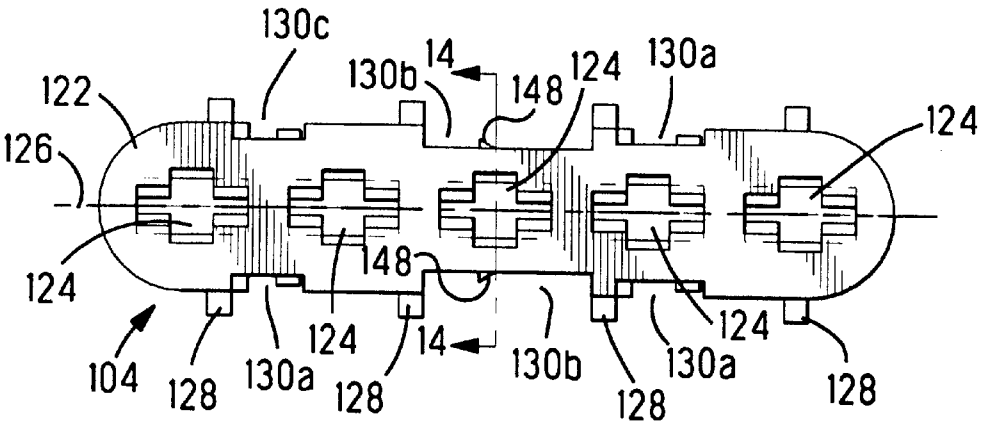
FIG. 13 shows a front view of a contact retention portion incorporated into the electrical connector of FIG. 9.
Figure 14:
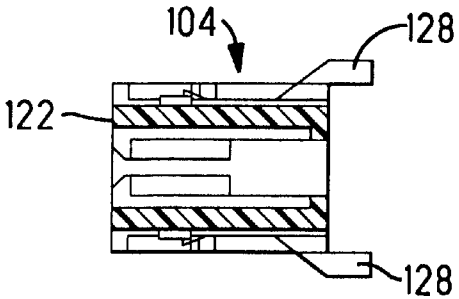
FIG. 14 shows a side sectional view of the contact retention portion of FIG. 13 taken along line 14—14.

With reference now to FIGS. 13–15 the contact retaining member 104 will now be described. The contact retaining member 104 has a front face 122 with a plurality of mating contact receiving openings 124 through which the mating connector tabs (not shown) enter into the connector and engage the contacts therein. The contact retaining member 104 is generally symmetrical about a longitudinal axis 126 defined thereby. A plurality of seal supports 128 extend rearward and are configured to cooperate with a seal (not shown) to retain the seal in position. A wing retaining region **130*a–c* is then formed between each seal support 128 that corresponds to the wings 116*a–c*. There a plurality of regions 130*a–c* are defined by a lower base surface 132 that is bordered on the outer ends 134 by raised walls 136 form which a camming post 138 extends outward from at least one of the walls 136. The camming post 138 includes a camming surface 140 facing in the direction of insertion of the contact retaining member 104 upon the housing 102 for cooperation therewith. The camming post 138 further includes a positioning surface 142 that in cooperation with the housing 102, as described below, assures that the contact retaining member 104 is positioned in the first position wherein contacts may be inserted into the connector. A retention surface 144 is disposed on the opposite side of the camming post 138 from the camming surface 140 in order to prevent the contact retaining member 104 from becoming disengaged from the housing 102 when in the second position. Further included along the base surface 132 are positioning posts 146 that ensure the contact retaining member 104 stays properly positioned upon the housing 102. Within the center wing receiving region 130*b* latches 148 extend outward and include a camming surface facing the direction of movement from the first position to the second position, thereby enabling displacement thereto, and a locking surface facing opposite the camming surface such that when the contact retaining member 104 has been displaced to the second position, it is difficult to move the contact retaining member 104** back to the first position.

Returning now to FIGS. 10–12, the housing 102 includes receiving notches 150 located along at least one of the wings **116*a–c* that correspond to the camming post 138 of the contact receiving member 104. In addition, the wings also include ports 152 that are sized to receive the posts 146 therein and prevent the contact retaining member 104 from being removed from the housing 102. In addition, one of the wings 116*b* includes a latch receiving feature 154 having first and second regions 156,158 respectively for receiving the latch 148 therein in corresponding first and second positions of the contact retaining member 104**.

With reference now to FIG. 9, the assembly of the connector 100 will be described in greater detail. Initially, the contact retaining member 104 is set upon the connector with the wing portions **116*a–c* corresponding to the wing receiving regions 130***a–c*. It is possible to have this initial assembly with either the contact retaining member 104 in the first or second position. It is typically difficult to visually align the two at this time as the distance between the first and second positions is usually small and the contact retaining member 104 is to be seated within the outer shroud 118. While in this embodiment the positioning latching structure 148,154 does not engage until the contact retaining member 104 is almost fully inserted in the direction of arrow B, even if it were to be constructed to be initially engaged as the contact retaining member 104 is mounted upon the housing 102, there would still be difficulties in assuring the proper alignment occurs and is maintained during insertion. In order to avoid these difficulties, the camming post 138 is constructed so that as the contact retaining member 104 is inserted in the direction of arrow B, the leading camming surface 140 comes into contact with the camming surface 160 that is located along one of the wings 116*c*. As a result of further insertion in the direction of arrow B the contact retaining member 104 is displaced to one side and into the first position as biasing surface 142 passes along the corresponding positioning surface 162. When the contact retaining member 104 has been fully inserted so that the posts 146 are received within the latching ports 152, the camming post 138 is displaced opposite the notch 150 such that upon displacement of the contact retaining member 104 to the second position, the camming post 138 is received within the receiving notch 150. As can be further seen, the ports 152 are oversized in relation to the posts 146 thereby enabling the transverse movement of the contact retaining member 104.

While the aforegoing is described with respect to an electrical connector having camming shoulders formed in the housing that are exposed upon displacement of the contact retaining member 104, this invention is just as applicable to other known secondary locking members. In addition, while the wing receiving regions 130*a–c* are shown as open channels it is also envisioned that these channels could be enclosed such that the wings 116*a–c* are received within slots formed in the contact retaining member 104.

Advantageously, the connector 2 may be shipped from manufacture to the assembly site with the seal 22 mounted upon the first part 4 and the second part 6 also engaged therewith in a position for receiving the electrical contact 86 within the terminal passageway 8. The electrical contact 86 may be inserted and seated by interaction of lances 91 with shoulders 92, but mating is prevented until the locking is positively effected by shifting the second part 6 to expose shoulder 60 behind the contact 86. Additionally, as camming features on both the housing and contact retaining member are configured to cooperate as the contact retaining member is seated upon the housing, it is possible to assure that the contact retaining member is reliably positioned such that the contacts may be positioned in the connector without requiring repositioning of the contact retaining member.

We claim:

1. An electrical connector comprising a housing having a terminal receiving passageway extending therethrough for receiving a terminal therein, the housing having a first part that includes an insertion portion of the terminal receiving passageway that defines a first longitudinal axis and a second part that is displaceable relative the first part between a first position where the terminals are insertable into the housing and a second position where the terminals are retained in the housing, the second part includes a contact retention portion of the terminal receiving passageway that defines a second longitudinal axis and at one end is in communication with the insertion portion of the first part and at the opposite end includes an opening aligned with the second longitudinal axis for receiving a complementary contact of a mating connector; where in the first position the first and second longitudinal axis are offset from one another such that the terminal when inserted is angularly skewed relative the first and second longitudinal axis and out of alignment with the opening and in the second position, the first and second longitudinal axis are aligned such that when the terminal would be aligned with the opening.

2. The electrical connector of claim 1, further characterized in that the first part includes a ramp along the insertion portion to provide an opening offset from the longitudinal axis thereof so that a retention shoulder is formed and the retention shoulder is exposed when the second part is moved into the second position.

3. The electrical connector of claim 1, further characterized in that the second part along the retention portion includes a shoulder for cooperating with a locking lance of the terminal inserted therein.

4. The electrical connector of claim 1, further characterized in that the terminal longitudinal axis is skewed relative the longitudinal axis of the insertion portion and the retention portion when the terminal is inserted into the housing with the second part in the first position.

5. The electrical connector of claim 1, further characterized in that the first part carries a seal member surrounded by shroud to form an annular cavity Wherein a portion of a mating connector component is to be received for forming a sealed connection and where the second part carries seal retaining members that assure the seal remains properly positioned.

6. The electrical connector of claim 1, further characterized in that the first part includes forwardly extending sides interconnected by a base to define a U-shaped seat wherein the second part is positioned.

7. The electrical connector of claim 6, further characterized in that the sides include features that cooperate with the second part to establishing the first and second positions.

8. The electrical connector of claim 1, wherein the second part includes an opening for closely receiving a mating terminal therein where said opening is aligned with the longitudinal axis of the second part, such that when in the first position the offset between the longitudinal axis of the contact and the longitudinal axis of the second part is sufficient to prevent insertion of the mating terminal into the contact.

9. The electrical connector of claim 1, wherein the connector housing includes a plurality of terminal receiving passageways each being disposed in the first and second parts to define a row of passageways, said second part being displaceable from the first position to the second position by movement transverse to the row.

10. The electrical connector of claim 1, wherein the insertion portion of the terminal receiving passageway is configured for cooperation with a single wire sealing member.

* * * * *